US008026189B1

(12) United States Patent
Pryne et al.

(10) Patent No.: US 8,026,189 B1
(45) Date of Patent: Sep. 27, 2011

(54) HIGH-TEMPERATURE AND FIRE-RESISTANT FABRIC AND A METHOD OF MANUFACTURING THEREOF

(75) Inventors: Scott H. Pryne, Cornwall, NY (US); Arvind Patel, Hyde Park, NY (US); Wilson H. Pryne, Cornwall-on-Hudson, NY (US); Amad Tayebi, Westford, MA (US)

(73) Assignee: American Felt and Filter Company, LLC., New Windsor, NY (US)

( * ) Notice: Subject to any disclaimer, the term of this patent is extended or adjusted under 35 U.S.C. 154(b) by 554 days.

(21) Appl. No.: 12/080,601

(22) Filed: Apr. 4, 2008

Related U.S. Application Data

(60) Provisional application No. 60/921,978, filed on Apr. 5, 2007, provisional application No. 61/067,024, filed on Feb. 25, 2008.

(51) Int. Cl.
*D03D 11/00* (2006.01)
*D06C 11/00* (2006.01)

(52) U.S. Cl. ..... 442/205; 442/203; 442/206; 442/207; 428/91; 139/408; 139/410

(58) Field of Classification Search ..... 442/203, 442/205, 206, 207; 139/408, 409, 410, 413, 139/414; 428/91
See application file for complete search history.

(56) References Cited

U.S. PATENT DOCUMENTS

| | | | | | |
|---|---|---|---|---|---|
| 2,167,542 | A | * | 7/1939 | Barrell | 139/410 |
| 2,279,354 | A | * | 4/1942 | Walters | 431/325 |
| 2,861,600 | A | * | 11/1958 | Lawton | 139/385.5 |
| 3,484,183 | A | * | 12/1969 | Peters et al. | 8/116.1 |
| 3,541,582 | A | * | 11/1970 | Moreton et al. | 423/447.6 |
| 3,916,057 | A | * | 10/1975 | Hatch et al. | 442/414 |
| 4,332,600 | A | * | 6/1982 | Wegerhoff et al. | 65/472 |
| 4,332,601 | A | * | 6/1982 | Wegerhoff et al. | 65/472 |
| 4,500,593 | A | * | 2/1985 | Weber | 442/200 |
| 4,508,777 | A | * | 4/1985 | Yamamoto et al. | 442/415 |
| 4,849,273 | A | * | 7/1989 | Skinner et al. | 428/102 |
| 5,102,725 | A | * | 4/1992 | Knox et al. | 442/205 |
| 5,175,034 | A | * | 12/1992 | De La Porte et al. | 428/36.1 |
| 5,520,999 | A | * | 5/1996 | Van Skyhawk et al. | 442/205 |
| 5,582,912 | A | * | 12/1996 | McCullough et al. | 428/367 |
| 6,383,623 | B1 | * | 5/2002 | Erb, Jr. | 428/299.7 |
| 6,551,951 | B1 | * | 4/2003 | Fay et al. | 442/82 |

(Continued)

FOREIGN PATENT DOCUMENTS

JP 58041697 A * 3/1983

OTHER PUBLICATIONS

Definition of "double-cloth construction," Dictionary of Fiber and Textile Technology, Hoechst Celanese, p. 46, 1990.*

*Primary Examiner* — Cheryl Juska
(74) *Attorney, Agent, or Firm* — Amad Tayebi

(57) ABSTRACT

A method of making a high-temperature and fire-resistant fabric is described in which staple carbon fiber yarns are woven into a unified multi-layer woven fabric. The warp ends and filling picks of the unified multi-layer woven structure are positioned such that they prevent penetration of fire flames, welding sparks and molten metal spatter from penetrating through the unified multi-layer fabric.

2 Claims, 4 Drawing Sheets

U.S. PATENT DOCUMENTS 6,579,396 B2 * 6/2003 Erb, Jr. ..... 156/166
6,696,374 B2 * 2/2004 Bridgeman et al. ..... 442/402
6,959,855 B2 * 11/2005 Bridgeman et al. ..... 228/214
7,628,810 B2 * 12/2009 Christie et al. ..... 623/5.13
7,700,191 B2 * 4/2010 Zhu et al. ..... 428/364
2002/0031969 A1 * 3/2002 Bridgeman et al. ..... 442/402
2004/0128808 A1 * 7/2004 Bridgeman et al. ..... 28/107
2005/0221706 A1 * 10/2005 Bader et al. ..... 442/181
2009/0019614 A1 * 1/2009 Hagihara et al. ..... 2/16
2009/0053954 A1 * 2/2009 Zhu et al. ..... 442/302

* cited by examiner

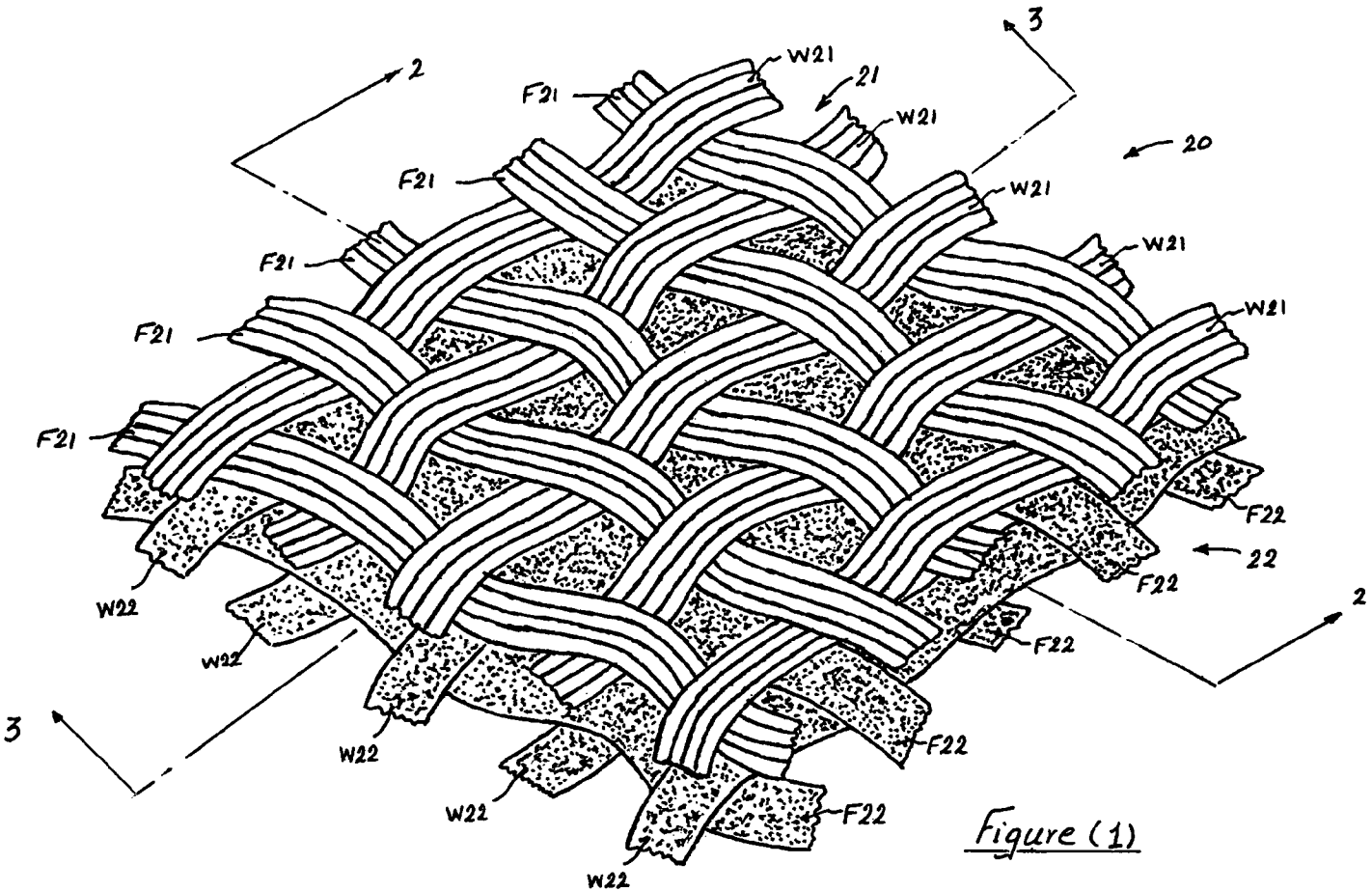
Figure (1)

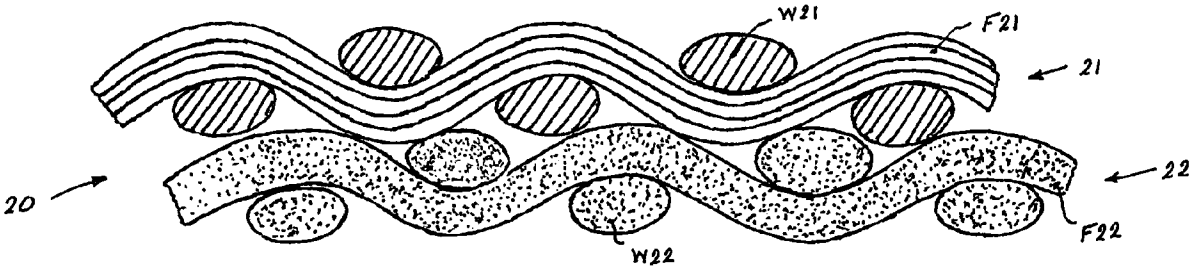
Figure (2)
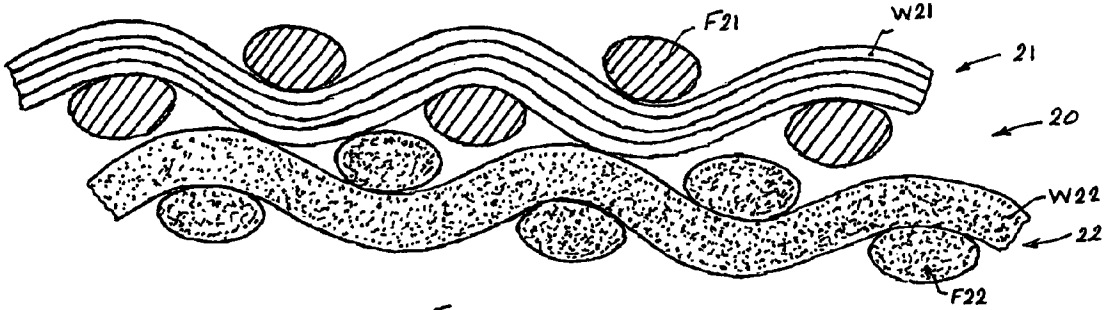
Figure (3)

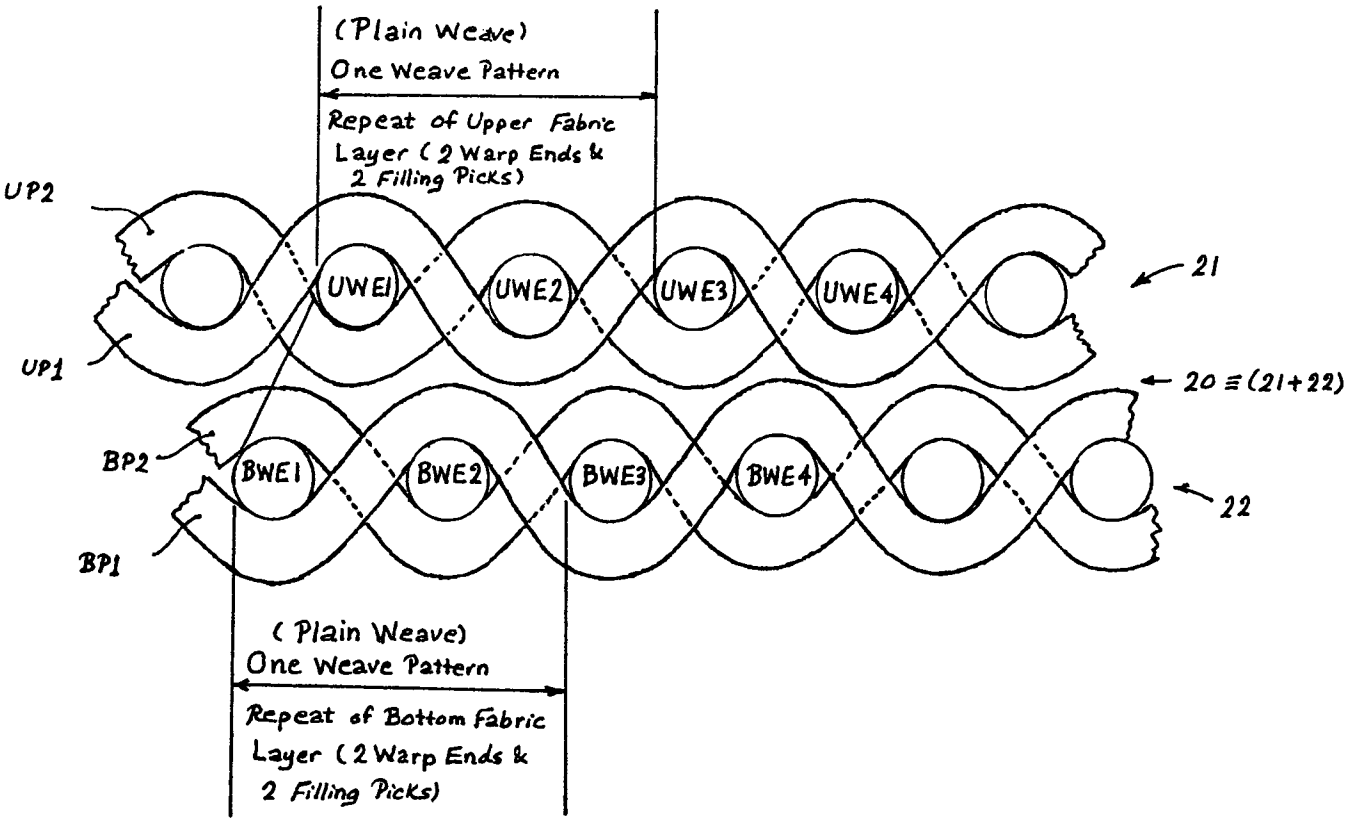
Figure (4)

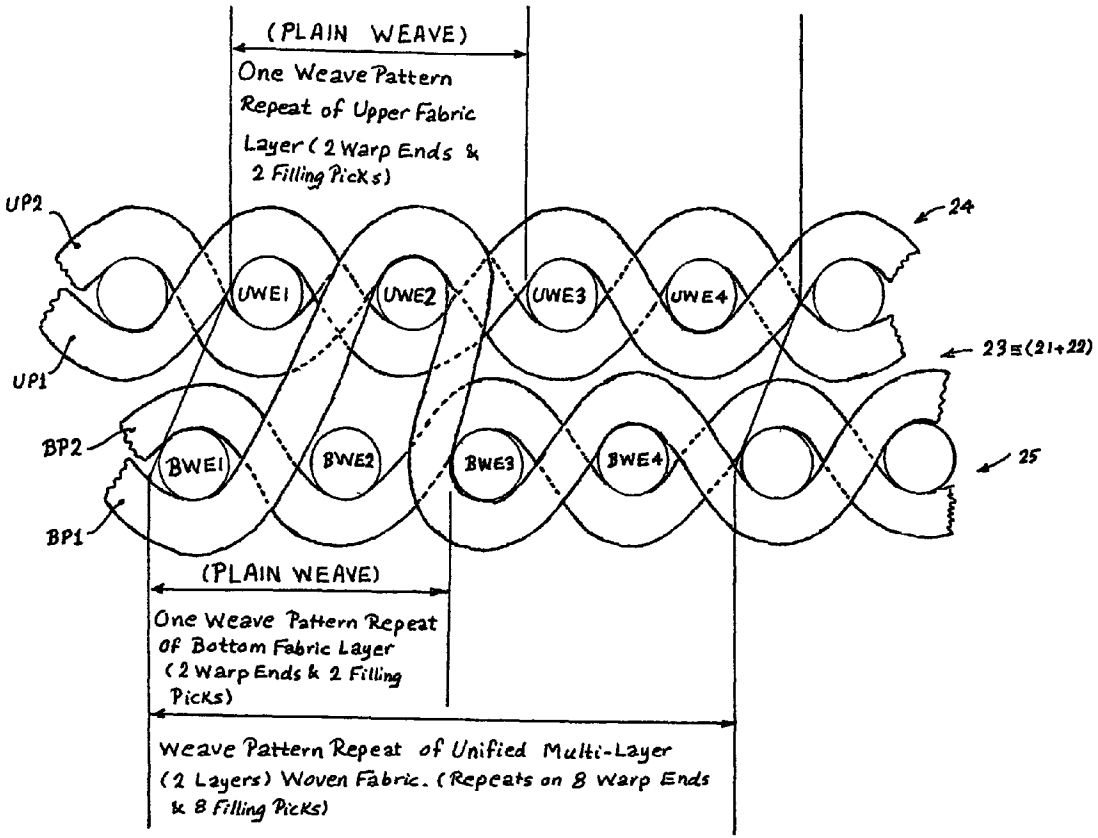
Figure (5)

HIGH-TEMPERATURE AND FIRE-RESISTANT FABRIC AND A METHOD OF MANUFACTURING THEREOF

PRIORITY STATEMENT

This application claims priority of Provisional Patent Application No. 60/921,978, titled "High Temperature and Fire-Resistant Carbon Fiber Fabric and a Method of Manufacturing Thereof" and filed on Apr. 5, 2007 and Provisional Patent Application No. 61/067,024, titled "High Temperature and Fire Resistant Blended Fiber Fabric and a Method of Manufacturing Thereof" and filed on Feb. 25, 2008. The contents of the above-referenced Provisional Patent Applications are incorporated in this application, in their entireties.

FIELD OF THE INVENTION

The present invention is in the field of high temperature and fire resistant flexible materials. In particular, the present invention is directed to i) unified multi-layer woven and knitted fabrics made of staple carbon and non-carbon, for example wool, fiber blends and treated to raise fibers on their surfaces so that inter-yarn apertures in the woven or knitted fabric are closed, ii) method of making said unified multi-layer woven and knitted fabrics and iii) novel uses of same. Thus, when the fabrics of the present invention are used, for example as protective welding blankets, welding sparks and molten metal welding spatter are prevented from penetrating through the multi-layer fabric and causing damage to the surface protected by the welding blanket. Other uses of the intimately blended carbon and non-carbon (for example wool) fibers fabrics of the present invention include safety apparel linings, cuffings, underwear, socks and hoods, hearth protection applications, including hearth pads (rugs), fire retardant/retarding walls and liners in buildings, naval vessels, automotive and aircraft applications, laminates to high temperature-resistant silica structures, circuit boards, helmet linings, fire extinguishing blankets and other high temperature and fire resistant fabric applications.

BACKGROUND OF THE INVENTION

Typical welding blankets of the prior art are made of carbon-based fibers formed into needle-punched non-woven fabrics. For example, a needle punched carbon fiber welding blanket is described in U.S. Pat. No. 6,696,374 issued to Bridgeman, et al, which is incorporated herein, by reference, in its entirety. Other related prior art patents include U.S. Pat. Nos. 3,916,057, 4,332,600, 4,332,601, 4,500,593, 4,508,777, 4,849,273, 5,582,912, 6,383,623, 6,551,951, and 6,579,396. Each of these related prior art patents is incorporated herein, in its entirety, by reference.

The present invention provides economic, yet effective and drapeable/flexible alternatives to single layer sheet materials of the prior art, including needle punched nonwovens and single layer woven and knitted carbon-based fiber fabrics of the prior art. The sheet materials of the present invention are either woven or knitted materials and their layers may be unified together during the weaving or knitting process or, alternatively, may be stitched together in a separate/subsequent, post weaving or knitting process/step.

DESCRIPTION OF THE DRAWINGS

FIG. 1 is an isometric view of 2 distinct layers of plain woven fabric 20 (Plain Weave), showing the upper layer (layer 21) and distinct, unbounded bottom layer (layer 22). As shown therein, W21 and F21 are, respectively, the warp ends and filling picks of upper layer 21 and W22 and F22 are, respectively, the warp ends and filling picks of bottom layer 22.

FIG. 2 is a cross sectional view of assembly 20 (shown in FIG. 1) in direction 2. (Note coverage of inter-yarn apertures of bottom layer 22 by yarns of top layer 21, and vice versa).

FIG. 3 is a cross sectional view of assembly 20 (shown in FIG. 1) in direction 3. (Note coverage of inter-yarn apertures of bottom layer 22 by yarns of top layer 21, and vice versa).

FIG. 4 is a cross-sectional view, perpendicular to warp ends, of assembly 20, showing two distinct/separate layers of staple fiber yarn (e.g., carbon fiber yarn) woven fabrics 21 and 22, positioned above one another such that the warp ends of one layer cover/fill the open space between the warp ends of the other layer. Similarly, a cross-sectional view, perpendicular to filling picks, would show the filling picks of one layer cover/fill the open space between the filling picks of the other layer, thus closing/covering inter-yarn apertures in both fabrics. As shown therein, UWE1, UWE2, UWE3 and UWE4 are, respectively, the first, second, third and fourth upper fabric layer warp ends, BWE1, BWE2, BWE3 and BWE4 are, respectively, the first, second, third and fourth bottom fabric layer warp ends, UP1 and UP2 are, respectively, the first and second upper fabric layer filling picks and BP1 and BP2 are, respectively, the first and second bottom fabric layer filling picks.

FIG. 5 shows a cross-sectional view, perpendicular to warp ends, of unified multi-layer fabric 23, made by inter-laminar interlacing of the two distinct fabrics 24 and 25. Interlacing of the two fabrics is performed on the loom during the weaving process. As shown therein, the interlaced structure repeats over 8 warp ends and 8 filling picks.

DETAILED DESCRIPTION OF THE INVENTION

In accordance with the present invention, a unified multi-layer high temperature and fire resistant intimately blended carbon and non-carbon, preferably wool, fiber fabric for welding blanket and other described earlier applications comprises: at least two layers of woven fabrics, each of said woven fabrics being made of warp and filling yarns interlaced/woven in accordance with a respective weave pattern, said warp and filling yarns comprising or being made of staple/discontinuous intimately blended carbon and non-carbon, preferably wool, fibers in order to provide a fuzzy/hairy fabric surface which would help to prevent fire flames from penetrating through the fabric and/or to arrest hot molten metal particles/spatter and sparks generated during welding.

Alternatively, said warp and filling yarns may also comprise ceramic and/or metallic fibers and/or wires, said metallic (for example, steel, aluminum, copper, . . . ) fibers being in the form of yarns or wires, said yarns, and/or wires being integral components of at least one of said at least two layers of woven fabrics, said staple intimately blended carbon and non-carbon, preferably wool, fibers being twisted together to form said warp and filling yarns, said at least two layers of woven fabrics forming an upper layer woven fabric and a bottom layer woven fabric, said upper layer woven fabric comprising upper fabric layer warp threads and upper fabric layer filling picks, said upper fabric layer warp threads and upper fabric layer filling picks being interlaced in accordance with a first weave pattern, said first weave pattern repeating over a first number of warp threads and a first number of filling picks, said bottom layer woven fabric comprising bottom fabric layer warp threads and bottom fabric layer filling picks, said bottom fabric layer warp threads and bottom fabric layer filling picks being interlaced in accordance with a second weave pattern, said second weave pattern repeating over a second number of warp threads and a second number of filling picks, said first weave pattern and said second weave pattern may be plain weave pattern, twill weave, satin weave, rib weave, or any other weave pattern and may be identical to one another or different from one another, said upper fabric layer and said bottom fabric layer forming a unified multi-layer woven structure, said unified multi-layer woven structure having a third weave pattern repeating over a third number of warp threads and a third number of filling picks wherein, said third number of warp threads being at least equal to said first number of warp threads plus said second number of warp threads and wherein said third number of filling picks being at least equal to said first number of filling picks plus said second number of filling picks, and wherein at least one of said upper fabric layer warp yarns/threads being permanently positioned/interlaced below at least one of said bottom fabric layer filling threads, thereby tying or unifying together said at least two layers of woven fabrics into a unified multi-layer intimately blended carbon and non-carbon, preferably wool, fibers fabric, and/or alternatively wherein at least one of said upper fabric layer filling picks/yarns/threads being permanently positioned/interlaced below at least one of said bottom fabric layer warp yarns/threads, thereby tying or unifying together said as least two layers of woven fabrics into a unified multi-layer blended carbon and wool fibers fabric, said unified multi-layer blended carbon and non-carbon, preferably wool, fibers fabric further being needle punched and/or napped, thereby causing at least some of the staple carbon and wool fibers of said yarns to break and form a napped surface, thereby preventing molten metal welding spatter, welding sparks and fire flames from penetrating through inter-yarn apertures and/or between said yarns.

Although the unified multi-layer woven fabric of the present invention may be made in high basis weight (high ounces per square yard), e.g. fabrics weighing 60 oz/sq.yd., it is readily deformable in bending and in shear. The absence of adhesives and/or chemical bonding agents permits the fibers and the yarns to move relative to one another and thus makes it possible to readily shape the multi-layer fabric into three dimensional double curvature shapes, such as the surface of a sphere.

The unified multi-layer woven or knitted fabric of the present invention is fed into a needle punching loom in order to mechanically entangle the staple fibers together thus enhancing the stability of the multi-layer fabric. Needle punching looms and the needle punching processes are known to those skilled in the art, thus will not be described in this disclosure. The movement of the barbed needles, in a needle punching loom, up and down through the unified multi-layer fabric of the present invention, intermingles the fibers, breaks some fiber and raises some fiber ends and loops to the exterior surface of the unified multi-layer fabric. Such raised fiber ends and loops form an enhanced exterior napped surface which further closes any inter-yarn apertures and thus further contributes to preventing any molten metal welding spatter from traveling/penetrating through the fabric/welding blanket to the surface to be protected by the fabric/welding blanket.

Though other basis weights (expressed in gm/square meter or in ounces per square yard) are achievable, a preferred basis weight of a single layer of the unified multi-layer woven fabric of the present invention weighs about 300 gm per square meter (8.84 ounces per square yard).

The staple/discontinuous blended carbon and non-carbon, preferably wool, fibers are formed into yarns either on a cotton/synthetic fiber opening, blending and picking, carding, drawing, roving and spinning system or on a woolen or worsted opening, blending and picking, carding, roving and spinning system. Yarn formation processes on each of the above-mentioned systems are known to those skilled in the art and, as such, will not be described in this disclosure.

As it is known to those skilled in the art of spinning of staple (discontinuous) fibers into yarn, staple carbon fibers are difficult, and in some cases are nearly impossible to process, on the cotton, on the woolen or on the worsted yarn formation systems. This is due to the brittleness of the fully carbonized fibers. In order to overcome the difficulties and limitation encountered in carbon or partially, but substantially, carbonized fibers processing and in accordance with the present invention, partially carbonized fibers are intimately blended with wool fibers and processed on standard/conventional staple fiber processing/yarn formation equipment (including the cotton, woolen and worsted yarn formation systems) including fiber opening and picking equipment, carding machines, and roving, spinning and twisting frames.

In accordance with the present invention, the wool fibers are used, in an intimately blended fiber blend with the carbon fibers, in order to act as carrier fibers and help transfer the carbon fiber from one surface of the processing equipment to the next surface, for example, form the licker-in (taker-in) surface to the cylinder surface or from the cylinder surface to the doffer surface in a carding machine. In accordance with the present invention, other non-carbon staple fibers, which may be used in lieu of the wool fibers, include cotton fibers, rayon fibers, partially or completely oxidized rayon fibers, polyacrylonitrile fibers, partially or completely oxidized polyacrylonitrile fibers, acetate fibers, acrylic fibers, modacrylic fibers including self-extinguishing modacrylic fibers, thermoplastic fibers such as nylon, polyester and polypropylene fibers, aramid fibers (such as Kevlar), saran fibers and bicomponent fibers (such as low melting point sheath-high melting point core bicomponent polyester fibers) or other fibers which may be processed on conventional cotton, worsted or woolen yarn formation equipment.

In accordance with the present invention, wool fibers are particularly suited and preferred, as a blend component in an intimately-blended carbon and non-carbon fiber blend, because of their natural crimp and texture and their exterior surface which offers a higher interfiber coefficient of friction, thus enabling the wool fibers to act as carriers of the carbon fibers through the equipment of the fiber processing system without sagging or breaking the continuity of the fiber mass.

In accordance with the present invention, an intimately blended non-carbon and carbon fibers blend may comprise non-carbon fibers with a weight ratio in the range of 5% to 70%. For example, by intimately blending 20%, by weight, wool fibers with 80%, by weight, staple carbon fibers, the processability of the carbon fibers into yarns on conventional yarn formation systems is greatly enhanced. The produced yarn is woven satisfactorily into a unified double layer fabric, as described earlier in this disclosure, and subsequently needle punched, napped and/or fulled as described in this disclosure, Though staple blended carbon and non-carbon fibers of a variety of fiber deniers and staple lengths may be suitable for making the yarns for use in weaving the unified multi-layer fabric of the present invention, a commercially available 2.2 denier, 2" staple length carbon fiber was used for making yarns which were woven into a welding blanket featuring the above-described characteristics. Other partially carbonized fibers which were also used successfully, are partially oxidized (63% oxidized) acrylic (polyacrylonitrile) fibers in 1.7, 2.2 and 5.0 denier and staple length of 1.5" to 3.0".

In accordance with the present invention, a two-layer (both layers being woven in a plain weave pattern) unified multi-layer fabric was obtained by using a singles intimately-blended carbon and non-carbon fibers yarn, having a cotton count of 3.22 (which is equivalent to 1650 denier) and 10 Z twist turns per inch, a total of 40 warp ends per inch (i.e., 20 warp ends per inch per layer), and a total of 36 filling picks per inch (i.e., 18 filling picks per inch per layer) arranged and interlaced, as described earlier, in a unified multi-layer fabric. The unified multi-layer (two-layer) fabric having a basis weight of 16.17 ounces per square yard, with the warp yarns and filling picks of each of the two layers covering the inter-yarn apertures of the other layer. The fabric was then processed on a napping machine in order to raise the fibers on both sides of the fabric and on a fulling machine in order to increase the basis weight and bulk of the fabric. Napping and fulling machines are known as in the art and, thus, will not be described in this disclosure. After allowing the fabric to relax, its basis weight increased to approximately 17.6 ounces per square yard which is a commercially adequate basis weight for welding blanket applications. For use as a welding blanket, the obtained fabric may be fabricated into a welding blanket by cutting it and trimming/hemming or binding its edges into a standard welding blanket of 3'×4', 5'×4', 4'×6', 5'×5', 6'×5', 6'×6', 8'×6', 8'×8', 6'×10', 8'×10', 10'×10' or any other custom, desired or special order dimensions.

In accordance with the present invention, a method for making a unified multi-layer high temperature and fire resistant intimately blended carbon and other non-carbon, preferably wool, fibers fabric for welding blanket and other, described earlier, applications comprised the steps of: providing warp and filling yarns comprising or being made of staple/discontinuous blended carbon and other non-carbon, (preferably wool), fibers, alternatively, said warp and filling yarns may also comprise ceramic and/or metallic fibers and/or wires, said staple intimately blended carbon and other non-carbon, (preferably wool), fibers being attenuated and twisted together to form said warp and filling yarns, weaving said warp and filling yarns into a unified multi-layer woven fabric comprising at least two layers of woven fabrics arranged into an upper layer woven fabric and a bottom layer woven fabric, said upper layer woven fabric comprising upper fabric layer warp threads and upper fabric layer filling picks, said upper fabric layer warp threads and upper fabric layer filling picks being interlaced in accordance with a first weave pattern, said first weave pattern repeating over a first number of warp threads and a first number of filling picks, said bottom layer woven fabric comprising bottom fabric layer warp threads and bottom fabric layer filling picks, said bottom fabric layer warp threads and bottom fabric layer filling picks being interlaced in accordance with a second weave pattern, said second weave pattern repeating over a second number of warp threads and a second number of filling picks, said first weave pattern and said second weave pattern may be plain weave pattern twill weave, satin weave, rib weave or any other weave pattern and may be identical to one another of different from one another, said unified multi-layer woven fabric/structure having a third weave pattern repeating over a third number of warp threads and a third number of filling picks, wherein, said third number of warp threads being at least equal to said first number of warp threads plus said second number of warp threads and wherein said third number of filling picks being at least equal to said first number of filling picks plus said second number of filling picks, and wherein at least one of said upper fabric layer warp yarns/threads being permanently positioned/interlaced below at least one of said bottom fabric layer filling threads, thereby tying or unifying together said at least two layers of woven fabrics into a unified multi-layer carbon fiber fabric, and/or alternatively wherein at least one of said upper fabric layer filling picks/yarns/threads being permanently positioned/interlaced below at least one of said bottom fabric layer warp yarns, threads, thereby tying or unifying together said at least two layers of woven fabrics into a unified multi-layer carbon fiber fabric, The above process/method may also further comprise needle punching, napping and/or fulling said multi-layer intimately blended carbon and non-carbon fibers fabric, thereby causing at least some of the staple carbon and non-carbon fibers of said yarns to break and form a napped surface, thereby causing preventing molten metal welding spatter, welding sparks and fire flames from penetrating through inter-yarn apertures and for between said yarns.

The above method may also further comprise allowing the fabric, after needle punching, napping and/or fulling, to relax and cutting the fabric and trimming, hemming or bonding its edges into a standard welding blanket 3'×4', 5'×4', 4'×6', 5×5', 6'×5', 6'×6', 8'×6', 8'×8', 6'×10', 8'×10', 10'×10' or any other custom, desired or special order dimensions.

The staple carbon fiber used in making the yarn and the fabrics of the present invention may be partially oxidized polyacrylonitrile (PAN) fibers that have not been fully oxidized to a pure carbon fiber state. Such staple fibers carbonize upon contact with molten weld spatter and prevent burn through of the welding blanket. Alternatively, though more challenging to process into yarns, fully or completely carbonized carbon staple fibers may be used for making the yarns and the fabrics of the present invention. Upon contact with molten metal weld spatter, such fibers absorb the heat content of the welding spatter without burning through.

Post weaving and knitting operations may include additional sewing in order to provide parallel rows of stitches. For example, in accordance with the present invention, a multi-layer welding blanket may be made of a separate/non-unified plurality of woven or knitted fabrics made of intimately blended staple carbon and non-carbon fibers or, alternatively, made of unified multi-layer woven or knitted fabric made of intimately blended staple carbon and non-carbon fibers, and have longitudinal rows of stitches and lateral rows of stitches which hold together the plurality of layers comprising the welding blanket or further enhance the interlaminar unification of the layers of the unified multi-layer fabric described earlier. Also, a conventional zigzag pattern of stitches may be used to bind together the edges of the welding blanket or the welding blanket layers and prevent unraveling of the edge yarns or loops and/or curling of the welding blanket edges.

The yarn used for the above described stitching may be a continuous monofilament or multi-filament yarn or a staple yarn, made form organic or inorganic fibers, including synthetic fibers, stainless steel fibers, aluminum fibers, or wires, carbon fibers, . . . , etc. In particular, aluminum wires are preferable since they may be used for shaping the welding blanket into a desired three dimensional-double curvature shape in order to more effectively protect the object under the welding blanket.

In accordance with the present invention and the method described above, a high-temperature and fire-resistant protective fabric, made in accordance with the above-described steps comprises:

a plurality of top layer warp yarns made of discontinuous intimately blended staple carbon fibers and having fiber ends protruding from said top layer warp yarns, said top layer warp yarns being parallel to one another and uniformly spaced from one another, having a yarn diameter of (DWT) and an inter-yarn spacing of (SWT), thus having a distance per yarn of (DWT+SWT) and a number of warp ends per inch of 1/(DWT+SWT), a plurality of top layer filling yarns made of discontinuous intimately blended staple carbon fibers and having fiber ends protruding from said top layer filling yarns, said top layer filling yarns being parallel to one another and uniformly spaced from one another, having a yarn diameter of (DFT) and an inter-yarn spacing of (SFT), thus having a distance per yarn of (DFT+SFT) and a number of filling threads per inch of 1/(DWT+SWT), a plurality of bottom layer warp yarns made of discontinuous intimately blended staple carbon fibers and having fiber ends protruding from said bottom layer warp yarns, said bottom layer warp yarns being parallel to one another and uniformly spaced from one another, having a yarn diameter of (DWB) and an inter-yarn spacing of (SWB), thus having a distance per yarn of (DWB+SWB) and a number of warp ends per inch of 1/(DWB+SWB), said yarn diameter (DWB) being at least equal to said inter-yarn spacing (SWT), and said plurality of bottom layer warp ends being positioned below and coinciding with said inter-yarn spacing (SWT) of said plurality of said top layer warp yarns, a plurality of bottom layer filling yarns made of discontinuous intimately blended staple carbon fibers and having fiber ends protruding from said bottom layer filling yarns, said bottom layer filling yarns being parallel to one another and uniformly spaced from one another, having a yarn diameter of (DFB) and an inter-yarn spacing of (SFB), thus having a distance per yarn of (DFB+SFB) and a number of filling yarns per inch of 1/(DFB+SFB), said yarn diameter (DFB) being at least equal to said inter-yarn spacing (SFT), and said plurality of bottom layer filling yarns being positioned below and coinciding with said inter-yarn spacing (SFT) of said plurality of said top layer filling yarns, said plurality of top layer warp yarns and said plurality of top layer filling yarns being interlaced, in accordance with a first weave pattern, to form an upper woven fabric layer, said first weave pattern repeating over a first number of warp threads and a first number of filling picks, said plurality of bottom layer warp yarns and said plurality of bottom layer filling yarns being interlaced, in accordance with a second weave pattern, to form a bottom woven fabric layer, said second weave pattern repeating over a second number of warp threads and a second number of filling picks, said upper woven fabric layer and said bottom woven fabric layer forming a unified multi-layer woven structure, said unified multi-layer woven structure having a third weave pattern repeating over a third number of warp threads and a third number of filling picks wherein, said third number of warp threads being at least equal to said first number of warp threads plus said second number of warp threads and wherein said third number of filling picks being at least equal to said first number of filling picks plus said second number of filling picks, and wherein said unified multi-layer woven structure having at least one of said top layer warp yarns being permanently positioned (interlaced) below at least one of said bottom layer filling yarns, thereby unifying together said top woven fabric and said bottom woven fabric into a unified multi-layer fabric, and wherein at least one of said upper fabric layer filling yarns being permanently positioned (interlaced) below at least one of said bottom fabric layer warp yarns, thereby tying or unifying together said at least two layers of woven fabrics into a unified multi-layer structure and preventing lateral and longitudinal shifting of said top layer warp yarns, top layer filling yarns, bottom layer warp yarns and bottom layer filling picks from shifting their respective relative positions, thus, and in combination with said protruding fiber ends, blocking the path of fire flames, sparks and/or welding molten metal spatter impacting the surface of said fabric and preventing said sparks from penetrating through said unified multi-layer fabric structure, said unified multi-layer fabric blended carbon and non-carbon, preferably wool, fibers fabric further being needle punched and/or napped, thereby causing at least some of the staple carbon and wool fibers of said yarns to break and form a napped surface, thereby preventing molten metal welding spatter, welding sparks and fire flames from penetrating through inter-yarn apertures and/or between said yarns.

The invention claimed is:

1. A high-temperature and fire-resistant protective fabric comprising;

a plurality of top layer warp yarns made of intimately blended staple carbon and non-carbon fibers and having fiber ends protruding from said top layer warp yarns, said top layer warp yarns being parallel to one another and uniformly spaced from one another, having a yarn diameter of (DWT) and an inter-yarn spacing of (SWT), thus having a distance per yarn of (DWT+SWT) and a number of warp ends per inch of 1/(DWT+SWT), a plurality of top layer filling yarns made of intimately blended staple carbon and non-carbon fibers and having fiber ends protruding from said top layer filling yarns, said top layer filling yarns being parallel to one another and uniformly spaced from one another, having a yarn diameter of (DFT) and an inter-yarn spacing of (SFT), thus having a distance per yarn of (DFT+SFT) and a number of filling threads per inch of 1/(DWT+SWT), a plurality of bottom layer warp yarns made of intimately blended staple carbon and non-carbon fibers and having fiber ends protruding from said bottom layer warp yarns, said bottom layer warp yarns being parallel to one another and uniformly spaced from one another, having a yarn diameter of (DWB) and an inter-yarn spacing of (SWB), thus having a distance per yarn of (DWB+SWB) and a number of warp ends per inch of 1/(DWB+SWB), said yarn diameter (DWB) being at least equal to said inter-yarn spacing (SWT), and said plurality of bottom layer warp ends being positioned below and coinciding with said inter-yarn spacing (SWT) of said plurality of said top layer warp yarns, a plurality of bottom layer filling yarns made of intimately blended staple carbon and non-carbon fibers and having fiber ends protruding from said bottom layer filling yarns, said bottom layer filling yarns being parallel to one another and uniformly spaced from one another, having a yarn diameter of (DFB) and an inter-yarn spacing of (SFB), thus having a distance per yarn of (DFB+SFB) and a number of filling yarns per inch of 1/(DFB+SFB), said yarn diameter (DFB) being at least equal to said inter-yarn spacing (SFT), and said plurality of bottom layer filling yarns being positioned below and coinciding with said inter-yarn spacing (SFT) of said plurality of said top layer filling yarns, said plurality of top layer warp yarns and said plurality of top layer filling yarns being interlaced, in accordance with a first weave pattern, to form an upper woven fabric layer, said first weave pattern repeating over a first number of warp threads and a first number of filling picks, said plurality of bottom layer warp yarns and said plurality of bottom layer filling yarns being interlaced, in accordance with a second weave pattern, to form a bottom woven fabric layer, said second weave pattern repeating over a second number of warp threads and a second number of filling picks, said upper woven fabric layer and said bottom woven fabric layer forming a unified multi-layer woven structure, said unified multi-layer woven structure having a third weave pattern repeating over a third number of warp threads and a third number of filling picks wherein, said third number of warp threads being at least equal to said first number of warp threads plus said second number of warp threads and wherein said third number of filling picks being at least equal to said first number of filling picks plus said second number of filling picks, and wherein said unified multi-layer woven structure having at least one of said top layer warp yarns being permanently positioned (interlaced) below at least one of said bottom layer filling yarns, thereby unifying together said top woven fabric and said bottom woven fabric into a unified multi-layer fabric, and wherein at least one of said upper fabric layer filling yarns being permanently positioned (interlaced) below at least one of said bottom fabric layer warp yarns, thereby tying or unifying together said at least two layers of woven fabrics into a unified multi-layer structure and preventing lateral and longitudinal shifting of said top layer warp yarns, top layer filling yarns, bottom layer warp yarns and bottom layer filling picks from shifting their respective relative positions, thus, and in combination with said protruding fiber ends, blocking the path of fire flames, sparks and/or welding molten metal spatter impacting the surface of said fabric and preventing said fire flames, welding sparks and welding molten metal spatter from penetrating through said unified multi-layer structure.

2. The high-temperature and fire-resistant protective fabric of claim 1 wherein said non-carbon fibers being wool fibers.

* * * * *